United States Patent [19]

Miyaji

[11] Patent Number: 4,710,018

[45] Date of Patent: Dec. 1, 1987

[54] VARIABLE MAGNIFICATION COPYING APPARATUS

[75] Inventor: Takashi Miyaji, Yamatokoriyama, Japan

[73] Assignee: Sharp Kabushiki Kaisha, Osaka, Japan

[21] Appl. No.: 886,612

[22] Filed: Jul. 18, 1986

[30] Foreign Application Priority Data

Jul. 19, 1985 [JP] Japan ..... 60-160959

[51] Int. Cl.[4] ..... G03G 15/00

[52] U.S. Cl. ..... 355/8; 355/3 R; 355/14 R; 355/14 SH; 355/14 E; 355/56

[58] Field of Search ..... 358/8, 3 R, 14 R, 14 SH, 358/14 E, 55, 56, 57

[56] References Cited

U.S. PATENT DOCUMENTS 3,806,241 4/1974 Gregg et al. ..... 355/56 X 4,277,163 7/1981 Ikesue et al. ..... 355/14 R 4,552,450 11/1985 Tomosapa et al. ..... 355/14 R 4,575,227 3/1986 Ito et al. ..... 355/56

*Primary Examiner*—A. C. Prescott

*Attorney, Agent, or Firm*—Birch, Stewart, Kolasch & Birch

[57] ABSTRACT

A variable magnification copying apparatus arranged to determine a scanning amount having a leading edge of an original document as a reference point, based on a copy paper size and a copying magnification as selected so as to control positions of a zoom lens assembly from the copying magnification, and characterized in that there are provided an original document trailing edge indicating plate disposed on a copy lamp unit for scanning the original document, and a device for displacing the original document trailing edge indicating plate together with the copy lamp unit based on the value calculated from the copy paper size and copying magnification, so as to set a terminal point of the displacement as a home position of the copy lamp unit.

3 Claims, 2 Drawing Figures

VARIABLE MAGNIFICATION COPYING APPARATUS

BACKGROUND OF THE INVENTION

The present invention generally relates to a copying apparatus and more particularly, to a variable magnification copying apparatus of a movable optical system type (i.e., stationary original document platform type).

With respect to the variable magnification copying apparatus of the above described type employing a zoom lens assembly, it has been attempted to further improve the magnification varying functions in order to cope with the recent diversification in the sizes of copy paper sheets to be employed. As a result, it has become possible to copy onto copy paper sheets of any sizes, and simultaneously, to effect copying from original documents of any sizes onto copy paper sheets of regular sizes.

Meanwhile, together with the improvement of the magnification varying functions, there have also been conventionally proposed various measures to prevent miscopying for the promotion of operability. In such proposed measures as referred to above, it is so arranged, for example, to input original document sizes, or to input values for original document sizes as detected by a scale attached to an original document platform.

In the known practice as described above, however, although not many problems are encountered with respect to the original document of a regular size, if the original document is of an irregular size, input of such an irregular original document size imposes a heavy burden on the operator, and the actual state is such that the magnification varying functions are not fully utilized effectively.

As described so far, in the conventional variable magnification copying apparatuses, there have been such disadvantages that they lack in efficient operability especially when original documents of irregular sizes are copied onto copy paper sheets of regular sizes through varied magnifications, thus being capable of producing miscopying or loss of images, etc.

SUMMARY OF THE INVENTION

Accordingly, an essential object of the present invention is to provide a variable magnification copying apparatus which is capable of effecting proper varied magnification copying corresponding to the copy paper sheet sizes, without the necessity for an operator to input original document sizes even when an original document of an irregular size is to be copied onto a copy paper sheet of a regular size.

Another important object of the present invention is to provide a variable magnification copying apparatus of the above described type, which is simple in construction and accurate in functioning, and can be readily manufactured at low cost.

In accomplishing these and other objects, according to the present invention, a home position of a copy lamp unit which has been set in a position prior to a leading edge of an original document, i.e., a reference point for a scanning amount in the conventional variable magnification copying apparatus is modified to be set at an original document trailing edge position.

More specifically, according to one preferred embodiment of the present invention, there is provided a variable magnification copying apparatus arranged to determine a scanning amount having a leading edge of an original document as a reference point, based on a copy paper size and a copying magnification as selected so as to control positions of a zoom lens assembly from the copying magnification, and characterized in that there are provided an original document trailing edge indicating plate disposed on a copy lamp unit for scanning the original document, and means for displacing the original document trailing edge indicating plate together with the copy lamp unit based on the value calculated from the copy paper size and copying magnification, thereby to set a terminal point of the displacement as a home position of the copy lamp unit.

In other words, in the present invention, it is so aranged that, by controlling the home position of the copy lamp unit according to the copy paper size and the copying magnification, a copying-possible region at the original document side corresponding to the selected copy paper size is displayed on the original document platform.

By the above arrangement of the present invention, an improved variable magnification copying apparatus has been advantageously presented.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
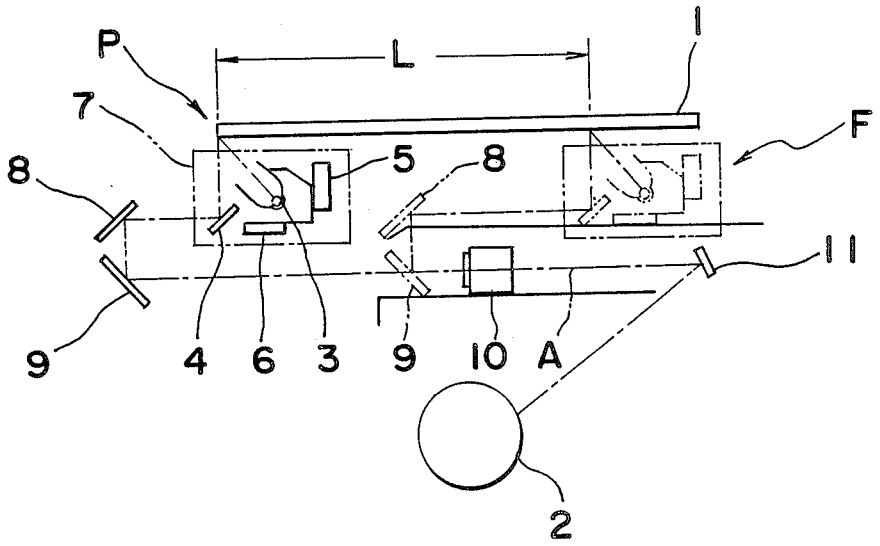
FIG. 1 is a schematic diagram showing a general construction at essential portions for a variable magnification copying apparatus according to one preferred embodiment of the present invention.

Before the description of the present invention proceeds, it is to be noted that like parts are designated by like reference numerals throughout the accompanying drawings.

Referring now to the drawings, there is shown in FIG. 1, a general construction at essential portions for an optical system moving type variable magnification copying apparatus of a mirror scanning type according to one preferred embodiment of the present invention.

In FIG. 1, the copying apparatus generally includes an original document platform 1 of a light transmitting material such as glass or the like provided at the upper portion of the copying apparatus, a photosensitive or photoreceptor drum 2 rotatably provided under the platform 1, and an optical system F provided between the original document platform 1 and the photoreceptor drum 2.

The optical system F further includes a copy lamp unit 7 having a copy lamp 3, a first mirror 4, an original document trailing edge indicating plate 5 and an AE sensor 6 (original document density detecting sensor), and a second mirror 8, a third mirror 9, a zoom lens assembly 10 and a fourth mirror 11 so as to direct images of an original document (not particularly shown) placed on the platform 1 onto the surface of the photoreceptor drum 2 through an exposing light path A.

In the variable magnification copying apparatus as described above, when the copying magnification is set through input of a magnification setting signal after turning on a power source, a scanning amount L by the copy lamp unit 7 having an original document leading edge as a reference point is determined based on the size of the copy paper sheets (not particularly shown) accommodated in a cassette and set within the copying apparatus, and the copying magnification referred to above, and the zoom lens assembly 10 is controlled for its position based on the copying magnification. Similarly, it is so arranged that, based on a value calculated from the copy paper size and the copying magnification, the copy lamp unit 7 is displaced from a position at the termination of the previous copying (present position) to a terminal point during scanning of the present copying. Thus, the terminal point of displacement of the above copy lamp unit 7 becomes the home position during the present copying, and this position is displayed on the original document platform 1 by the original document trailing edge indicating plate 5, whereby the operator finds the copying-possible region on the original document platform 1 corresponding to the selected copy paper size by visually recognizing the original document trailing edge indicating plate 5. Accordingly, in the copying mode, after the copy lamp unit 7 has been displayed from the above home position to the vicinity of the second mirror 8 located in a position further prior to (i.e., toward the left in FIG. 1) the original document leading edge position which is the reference point P, the unit 7 further returns to the reference point P, and subsequently, is displacd up to the home position, while scanning the original document.

It is to be noted here that the positions of the lens assembly 10 and the copy lamp unit 7 are being monitored at all times. More specifically, each of the lens assembly 10 and copy lamp unit 7 is driven by a DC stepping motor (not particularly shown), and the amount of displacement thereof from a predetermined reference position is detected by the number of output pulses of a rotary encoder (not shown) provided on a rotary shaft of the DC stepping motor. Accordingly, the original document trailing edge position is judged also by the counting of such pulses.

Figure 2:
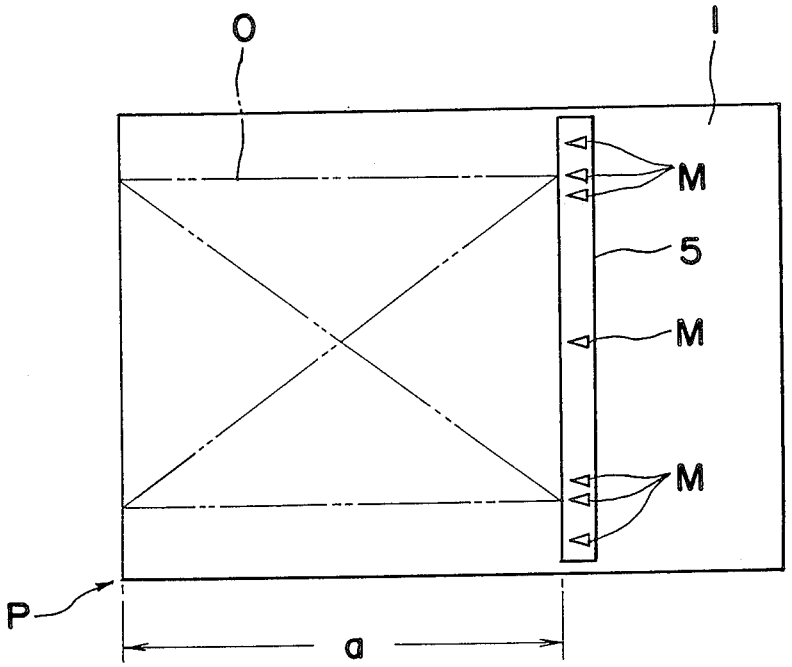
FIG. 2 is a top plan view of an original document platform employed in the copying apparatus of FIG. 1 for explaining contents of control to indicate a copying-possible region.

When the copy lamp unit 7 has been displaced to the home position, the original document trailing edge indicating plate 5 is set at the right side end of the copying-possible region on the original document platform 1, and the region between the position indicated by this original document trailing edge indicating plate 5 and the above reference point P represents the maximum limit for a lateral width of the original document which can be copied at the varied magnification to correspond to the copy paper size. On the other hand, as shown in FIG. 2, for example, if scale marks M are indicated on the original document trailing edge indicating plate 5, it is possible to know by referring to these scale marks M, the maximum limit for a longitudinal width of the original document which can be copied at the varied magnification to correspond to the copy paper size. Accordingly, by combining the maximum limit of the above lateral width and that of the above longitudinal width, the copying-possible region on the original document platform 1 may be found, and thus, the operator can effect the varied magnification copying without occurrence of mis-copying or image loss, etc. by merely placing the original document within the above region.

In the above arrangement, if the original document trailing edge indicating plate 5 is constituted by a light source unit whose light emitting face is controlled for its length according to the original document longitudinal width to be determined by the copy paper size and the copying magnification, the longitudinal width of the copying-possible original document to correspond to the copy paper size is displayed by the length of the light emitting face, while the original document placing position on the original document platform 1 can be visually recognized by the position of the light emitting face, and this, an accurate copying-possible region on the original document platform 1 may be readily found. Moreover, as a result, it also becomes possible to form a margin along the edge in a vertical direction of the copy paper sheets copied at a varied magnification so as to utilize such a marginal portion as a filing margin. The light source unit as described so far may be readily formed, for example, by aligning a plurality of light emitting diodes in one row.

Meanwhile, since the copy lamp unit 7 is provided with the AE sensor 6, and furthermore, arranged to necessarily return to the reference point at the scanning amount L from the home position (i.e., the original document trailing edge position) during starting of copying, it is possible to find the exposure amount through detection of the original document density by the AE sensor 6 during the returning movement thereof. The above function is similar to the so-called pre-scanning which is effected to detect original document density prior to actual copying in a conventional copying apparatus. However, although the optical system must be moved for one going and one returning in the conventional pre-scanning, it may be moved only in one direction according to the present embodiment, with simultaneous detection of density for the full lateral width of the original document. Accordingly, there is such an advantage that the set value of the exposure amount becomes accurate, together with an increase of othe copying speed.

Subsequently, referring particularly to FIG. 2, the copy paper sizes and moving positions of the original document trailing edge indicating plate 5 will be explained specifically.

In FIG. 2, it is assumed that the home position of the copy lamp unit is set at the original document leading edge position, i.e., at a position spaced from the reference point of the scanning amount by a distance "a" (a=L), with the original document trailing edge indicating plate 5 being also set at the position.

In the case where the copying is effected at an equal size magnification or life size onto a copy paper sheet of A4 size at a copying magnification m=1, the distance "a" is equivalent to the lateral width of an original document O of A4 size.

Meanwhile, when copying is effected at a varied magnification onto an A4 size copy paper sheet at the copying magnification m=0.7, the distance "a" is equivalent to a distance obtained through multiplication of the lateral width of the A4 size original document by a reciprocal of the copying magnification m=0.7, i.e., equivalent to the lateral width of an original document O of A3 size. This processing is for the reduction mode for A3 to A4 size.

In the case where copying is made at a varied magnification onto an A3 size copy paper sheet by the copying magnification m=1.20, the distance "a" is equivalent to a distance obtained through multiplication of the lateral width of the A3 size original document by a reciprocal of the copying magnification m=1.20, i.e., equivalent to the lateral width of an original document O of A4 size. Since the size of an A3 size copy paper sheet is 420×297 mm and that of an A4 size original document O is 350×247.5 mm, the above case relates to an enlarging mode for A4 to A3 mode. Meanwhile, on the assumption that the size of the original document is 320×247.5 mm, if a varied magnification copying is effected, with the left side edge of the original document O aligned with the reference point P of the scanning amount L, a margin is formed at the trailing edge of the copy paper sheets after the copying so as to be utilized as a filing margin, while on the contrary, when a varied magnification copying is effected, with the right side edge of the original document O being aligned with the original document trailing edge indicating plate 5, a margin is formed at the leading edge of the copy paper sheets after copying, and can be utilized as a filing margin.

Hereinafter, general functioning in the copying mode will be described.

In the first place, the copy lamp unit 7 is shifted to the position further prior to the reference point P from the home position. In this case, the density of the original document is detected by the AE sensor 6 and the exposure amount is set. In other words, the output of the copy lamp 3 is set. In this case, the moving speed of the copy lamp unit 7 is high, and constant irrespective of the magnifications. Thereafter, the copy lamp unit 7 starts the original document scanning.

When the copying magnification is 1, the copy lamp unit 7 is displaced at a speed V by a distance equivalent to the lateral width of the original document, i.e., by the scanning amount, while simultaneously, the second mirror 8 and the third mirror 9 are shifted at a speed V/2 by a distance L/2. The zoom lens assembly 10 is set at the position of the equal size magnification, and projects light reflected from the original document onto the surface of the photoreceptor drum 2 rotating at a peripheral face speed V1=V. In the manner as described above, images of the original document are formed on the surface of the photoreceptor drum 2 at the magnification of 1:1.

For effecting copying at varied magnifications, setting of the copying magnification for the longitudinal width is first made by controlling positions of the zoom lens assembly 10, and the speed of the copy lamp unit 7 is set at $V=V1/m$ (where m represents the copying magnification). Meanwhile, the scanning amount L which is the moving length of the copy lamp unit 7 is set to 1/m times the lateral width of the copy paper sheet, because image loss or the like undesirably takes place if the scanning amount L is set to be larger than the above.

As is clear from the foregoing description, according to the present invention, since it is so arranged that the size of the original document which can be copied may be visually recognized accurately on the original document platform if the copy paper size and the copying magnification are known, mis-copying, image loss, etc. can be prevented through improved operability, while the burden of the operator is reduced due to elimination of troublesome procedures such as input of original document sizes by the operator as in the conventional practices. Furthermore, owing to the simple construction in which the original document trailing edge indicating plate is provided on the copy lamp unit, the variable magnification copying apparatus having an improved performance as described so far may be provided at low cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A variable magnification copying apparatus arranged to determine a scanning amount having a leading edge of an original document as a reference point, based on a copy paper size and a copying magnification as selected so as to control positions of a zoom lens assembly from the copying magnification, the improvement comprising an original document trailing edge indicating plate provided on a copy lamp unit for scanning the original document, and means for displacing said original document trailing edge indicating plate together with the copy lamp unit based on the value calculated from said copy paper size and copying magnification, thereby to set a terminal point of said displacement as a home position of said copy lamp unit.

2. A variable magnification copying apparatus as claimed in claim 1, wherein said original document trailing edge indicating plate is constituted by a light source unit, with a length of its light emitting face being controlled according to a longitudinal width of the original document determined by the copy paper size and the copying magnification.

3. A variable magnification copying apparatus as claimed in claim 1, wherein said copy lamp unit is provided with an original document density detecting sensor.

* * * * *